US009272892B2

(12) United States Patent
Kuehl et al.

(10) Patent No.: US 9,272,892 B2
(45) Date of Patent: Mar. 1, 2016

(54) ENHANCED HEAT TRANSFER TO WATER

(71) Applicant: Whirlpool Corporation, Benton Harbor, MI (US)

(72) Inventors: Steven John Kuehl, Stevesville, MI (US); Alexandre Azevedo, St. Joseph, MI (US); Nihat O. Cur, St. Joseph, MI (US); Alisson Costa Dasilva, Joinville (BR); Gustvo Lazzaris Debona, Joinville (BR); Marcos Heinzle, Joinville (BR); Leandro Berno Lidio, Joinville (BR); Verne H. Myers, Benton Harbor, MI (US)

(73) Assignee: Whirpool Corporation, Benton Harbor, MI (US)

( * ) Notice: Subject to any disclaimer, the term of this patent is extended or adjusted under 35 U.S.C. 154(b) by 157 days.

(21) Appl. No.: 13/952,693

(22) Filed: Jul. 29, 2013

(65) Prior Publication Data

US 2015/0027159 A1 Jan. 29, 2015

(51) Int. Cl.

| | |
|---|---|
| ***F25D 3/00*** | (2006.01) |
| ***B67D 1/08*** | (2006.01) |
| ***F25D 31/00*** | (2006.01) |
| *B67D 1/00* | (2006.01) |

(52) U.S. Cl.

CPC ..... *B67D 1/0861* (2013.01); *F25D 31/002* (2013.01); *B67D 1/0004* (2013.01); *B67D 1/0014* (2013.01); *B67D 1/0021* (2013.01); *B67D 1/0057* (2013.01)

(58) Field of Classification Search

CPC .. B67D 1/0861; B67D 1/0009; B67D 1/0864; B67D 1/0857; B67D 1/0043; B67D 1/0046; B67D 1/0054; F25D 31/002; F25D 31/003; F25D 31/006; B01F 2015/061; B01F 15/065

See application file for complete search history.

(56) References Cited

U.S. PATENT DOCUMENTS

| | | | | |
|---|---|---|---|---|
| 1,837,416 | A * | 12/1931 | Ebinger | 62/394 |
| 3,200,610 | A | 8/1965 | Van Steenburgh, Jr. | |
| 3,252,424 | A | 5/1966 | Van Steenburgh, Jr. | |
| 5,399,300 | A | 3/1995 | Notar | |
| 5,443,763 | A | 8/1995 | Notar | |
| 5,474,717 | A | 12/1995 | Bucher | |
| 5,732,563 | A | 3/1998 | Bethuy | |
| 5,749,233 | A * | 5/1998 | Adolfsson | 62/50.2 |
| 5,984,144 | A * | 11/1999 | Wyatt | 222/146.6 |
| 5,987,897 | A | 11/1999 | Hall | |
| 6,240,734 | B1 | 6/2001 | Ferrier | |
| 6,324,911 | B1 | 12/2001 | Scarffe | |
| 6,339,930 | B2 | 1/2002 | Horey | |

(Continued)

*Primary Examiner* — Mohammad M Ali
*Assistant Examiner* — Christopher R Zerphey

(57) ABSTRACT

A beverage dispensing apparatus which includes a tank, a liquid inlet and a fluid dispensing system which includes a dispensing fluid conduit having a helical portion at least substantially vertically oriented within the interior volume of the tank. The beverage dispensing apparatus also includes a fluid circulating system that includes at least one fluid circulation conduit having an inlet portion positioned proximate the bottom portion of the tank and at least one outlet. A fluid cycling device is also included in the beverage dispensing apparatus and is configured to move fluid from the bottom portion of the tank to the fluid circulation conduit. The at least one outlet is configured to produce a fluid flow tangential to the orientation of the dispensing fluid conduit configuration. Evaporator coils extend around a perimeter of the tank's exterior sidewall surface and are configured to chill the fluid within the tank.

20 Claims, 5 Drawing Sheets

(56) References Cited

U.S. PATENT DOCUMENTS

| | | | | |
|---|---|---|---|---|
| 6,438,989 | B1 * | 8/2002 | Wolski et al. | 62/390 |
| 6,449,966 | B1 | 9/2002 | Bethuy | |
| 6,581,391 | B2 | 6/2003 | Horey | |
| 6,644,343 | B2 | 11/2003 | Bethuy | |
| 6,662,573 | B2 | 12/2003 | Hawkins, Jr. | |
| 6,854,282 | B2 | 2/2005 | Bethuy | |
| 7,146,818 | B2 | 12/2006 | Hawkins, Jr. | |
| 7,861,550 | B2 | 1/2011 | Knoll | |
| 8,341,975 | B2 | 1/2013 | Knoll | |
| 2005/0160759 | A1 * | 7/2005 | Chaney et al. | 62/389 |
| 2006/0196631 | A1 * | 9/2006 | Small et al. | 165/10 |
| 2011/0068128 | A1 | 3/2011 | Knoll | |
| 2011/0079612 | A1 | 4/2011 | Knoll | |
| 2011/0120921 | A1 * | 5/2011 | Kim | 210/97 |
| 2011/0268845 | A1 | 11/2011 | Fantappie | |
| 2014/0223942 | A1 * | 8/2014 | Lee et al. | 62/190 |
| 2014/0319175 | A1 * | 10/2014 | Tobler | 222/108 |

* cited by examiner

ENHANCED HEAT TRANSFER TO WATER

FIELD OF THE INVENTION

The present invention generally relates to a system providing enhanced heat transfer to a fluid, typically a fluid in a beverage machine, more typically a single serving beverage dispensing machine and a method constructing such systems/machines.

SUMMARY OF THE INVENTION

One aspect of the present invention includes a beverage dispensing apparatus having a tank configured to receive and retain fluid. The tank has a bottom surface and at least one upwardly extending perimeter sidewall that extends upward from the bottom surface and defines an interior volume. The apparatus further includes a liquid inlet which is configured to deliver fluid from a fluid source to the interior volume of the tank. The apparatus further includes a fluid dispensing system which includes a dispensing fluid conduit having a helical portion at least substantially vertically oriented within the interior volume of the tank. The dispensing fluid conduit has an inlet proximate a bottom portion of the tank and an outlet positioned out of the interior volume of the tank. The beverage dispensing apparatus also includes a fluid circulating system that includes at least one fluid circulation conduit having an inlet portion positioned proximate the bottom portion of the tank and at least one outlet. A fluid cycling device is also included in the beverage dispensing apparatus and is in fluid communication with the at least one fluid circulation conduit and is configured to move fluid from the bottom portion of the tank to the fluid circulation conduit. The at least one outlet is configured to produce a fluid flow tangential to the orientation of the dispensing fluid conduit configuration. Evaporator coils extend around at least a portion of a perimeter of the tank's exterior sidewall surface and are in thermal communication with the tank and are configured to chill the fluid within the tank.

Another aspect of the present invention includes a beverage dispensing apparatus having a tank configured to receive and retain fluid and having a bottom surface and at least one upwardly extending perimeter sidewall which extends upward from the bottom surface and defines an interior volume. A liquid inlet is configured to deliver fluid from a fluid source to the interior volume of the tank. The beverage dispensing apparatus further includes a fluid dispensing system which has a dispensing fluid conduit having a helical portion that extends from proximate the bottom of the tank to about the top surface of the tank and is at least substantially vertically orientated within an interior volume of the tank. The dispensing fluid conduit has an inlet proximate a bottom portion of the tank and an outlet positioned out of the interior volume of the tank. A fluid moving device is configured to move fluid within the tank into the inlet of the dispensing fluid conduit and out of the outlet. Further, the beverage dispensing apparatus includes a fluid circulating system which has at least one fluid circulation conduit having an inlet portion positioned proximate the bottom portion of the tank and at least one outlet positioned proximate the at least one perimeter sidewall of the tank. A fluid pump is in fluid communication with the at least one fluid circulation conduit and is configured to move fluid from the bottom portion of the tank to the fluid circulation conduit. The at least one outlet is configured to produce a fluid flow tangential to the orientation of the dispensing fluid conduit configuration. Evaporator coils extend around a perimeter of the tank's exterior in thermal communication and typically physically connected with the tank. The evaporator coils are configured and positioned to chill the fluid within the tank by removing heat via induction across the perimeter sidewall by direct physical contact of the evaporator with the outside surface of the sidewall of the tank. Additionally, at least one fin is typically disposed about in said perimeter of the storage tank and extending into the interior of the tank.

Yet another aspect of the present invention includes a method for producing a chilled beverage. First, at least one fluid, which is typically water, is received into a tank from a fluid source via a liquid inlet from a main fluid source that can be a municipal (city) water supply, a well or water storage tank. The water may also be filtered prior to or after residing in the tank. The tank includes a bottom surface, and at least one upwardly extending perimeter sidewall which extends upward from the bottom surface and defines an interior volume. The perimeter sidewall also includes an exterior surface and an interior surface. Next, the fluid is cooled inside of the tank using at least one evaporator coil in thermal communication with the tank and extends around at least a portion of a perimeter of the tank. The fluid is then circulated through at least one fluid circulation conduit having an inlet portion positioned proximate the bottom portion of the tank and at least one outlet. Next, the fluid is moved from the bottom portion of the tank into the fluid circulation conduit using a fluid cycling device, such as a pump, which is in fluid communication with the at least one fluid circulation conduit. A fluid flow is produced about and along the interior surface of the tank. The fluid typically circulates in a spiraling current of fluid (water). Finally, the fluid is dispensed to a user through a dispensing fluid conduit having a non-linear portion, an inlet proximate a bottom portion of the tank, and an outlet positioned out of the interior volume of the tank.

These and other features, advantages, and objects of the present invention will be further understood and appreciated by those skilled in the art by reference to the following specification, claims, and appended drawings.

DETAILED DESCRIPTION

Figure 1:
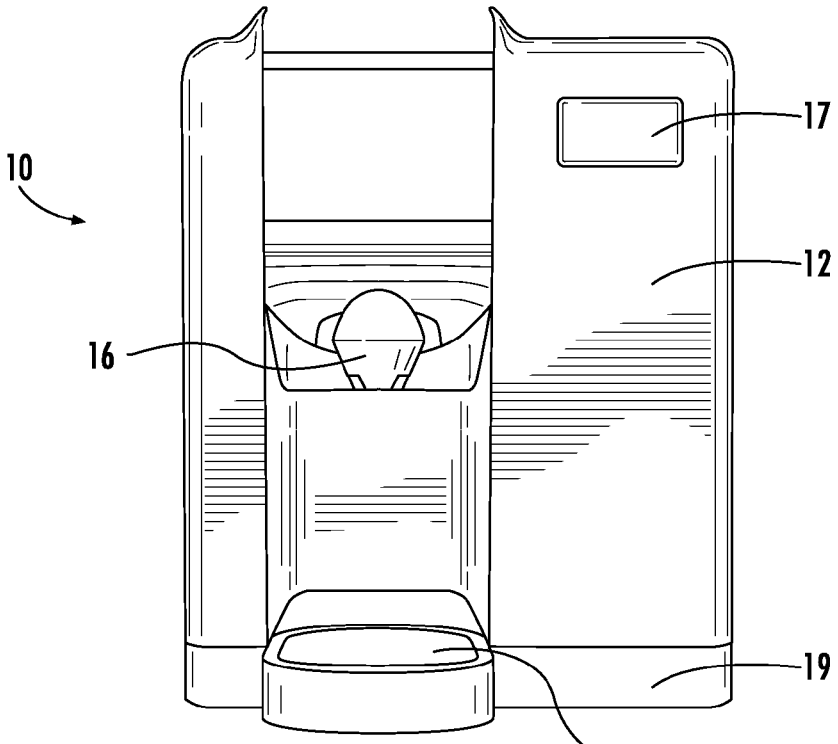
FIG. 1 is an elevated front view of a beverage dispensing apparatus according to an aspect of the present invention.

FIGS. 1-5 generally show a beverage dispensing apparatus 10. The beverage dispensing apparatus is typically a single serving beverage dispenser. The beverage dispensing apparatus 10 includes a tank 30, a fluid dispensing system 40, a fluid circulating system 50, and an evaporator 36.

The tank 30 is configured to receive and retain fluid. The tank 30 has a bottom surface 31 and at least one upwardly extending perimeter sidewall 33 which extends upward from the bottom surface 31 and defines an interior volume 32. The tank may be any three-dimensional shape with an interior volume to receive and retain a fluid; however, a cylindrical tank is most preferred for reasons discussed later in the application. In this case, the tank has single upwardly extending sidewall.

A liquid inlet 20 is configured to deliver fluid from a fluid source to the interior volume 32 of the tank 30. The liquid inlet delivers water to the tank interior from (1) a water supply tank that may be positioned within the beverage dispensing apparatus housing or outside the housing and in fluid communication with the beverage dispensing apparatus; (2) a municipal water source; (3) a well water source; and/or (4) a rainwater source provided the water has been filtered and/or treated such that it is potable water when it enters the tank or at the very least when it is dispensed to the consumer.

The beverage dispensing apparatus 10 further includes a fluid dispensing system 40 which includes a dispensing fluid conduit 42. The dispensing fluid conduit 42 typically has: a portion 44 that is typically helical or otherwise shaped to increase the travel time of liquid ascending from the inlet 46 to the outlet 48. In this manner the fluid dispenser has a more uniform temperature than a simple straight line or other conduit with a shorter length/fluid residence time in the tank. The dispensing fluid conduit 42 is typically at least substantially vertically oriented within the interior volume 32 of the tank 30. The dispensing fluid conduit's an inlet 46 or inlets are typically located proximate to (at least substantially adjacent) a bottom portion 34 of the tank 30. The dispensing fluid conduit 42 also has an outlet 48 which is typically positioned out of the interior volume 32 of the tank 30.

The beverage dispensing apparatus 10 also includes a fluid circulating system 50 which includes at least one fluid circulation conduit 52 having an inlet portion 46 positioned proximate the bottom portion 34 of the tank 30 and also has at least one outlet 56, but more typically a plurality of outlets 56. A fluid cycling device 58 is in fluid communication with the at least one fluid circulation conduit 52. The fluid cycling device 58 such as a pump or pressurization device is configured to move fluid and operates to move from the bottom portion 34 of the tank 30 to the fluid circulation conduit 52. The at least one fluid circulation conduit outlet is configured to produce a fluid flow which is tangential to the orientation of the dispensing fluid conduit 42 configuration. The outlet(s) may have a curvilinear portion at the terminal end to push fluid in a spiraling flow around the tank when the tank is cylindrical. In other words, the outlet(s) have an arcuate end to direct fluid flow in a substantially circular direction within the tank. Additionally, this system includes an evaporator 36 extending around a perimeter 39 of the tank 30. The evaporator 36 typically has a series of coils which may be formed with substantially U-shaped bends 37. The evaporator is in thermal communication with the outside of tank 30 and configured to chill the fluid within the tank 30. The fluid within the tank is chilled by conduction of heat from the tank into the evaporator coil.

FIG. 1 shows the beverage dispensing apparatus 10 of the present invention. Further, FIG. 1 shows a front surface 12 of the beverage dispensing apparatus 10 a display 17 and a dispenser 16 which is configured to dispense the fluid, which may be chilled flavored or unflavored liquid, typically flavored or unflavored water. The flavored or unflavored water may optionally also be carbonated using a carbonator in connection with the dispensing conduit. Typically the system would utilize an in-line carbonator if one is used, but any form of carbonator can be used in the present invention. The liquid/fluid is typically dispensed to a user upon a user command. The user may activate the dispensing apparatus by depressing a hard button or touch sensor activation switch conceivably the beverage dispensing apparatus may activate and dispense after receiving a command. The command may be a remote command from a wireless or wired computer network based upon user input received from a web page on a remote computer that is operably and communicatively linked using at least one cellular or computer network to the beverage dispensing apparatus or using a similarly connected mobile computing device such as a mobile phone or laptop computer or tablet computing device. In the case of a mobile phone or tablet computer these devices may receive the user and transmit instructions using a mobile application.

Figure 2:
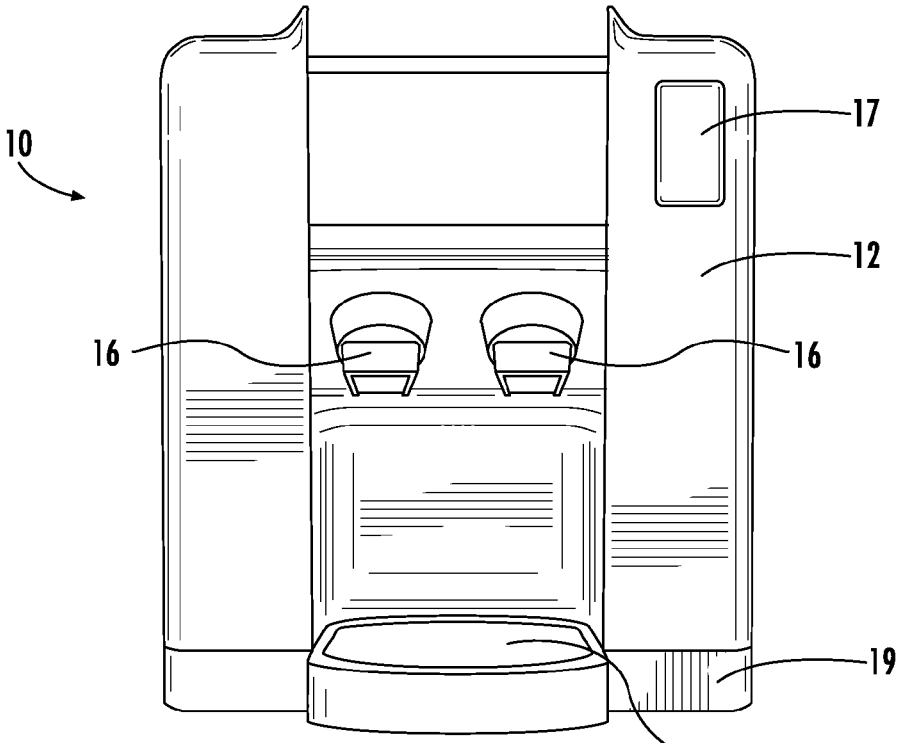
FIG. 2 is an elevated front view of another embodiment of a beverage dispensing apparatus according to an aspect of the present invention.
Figure 3:
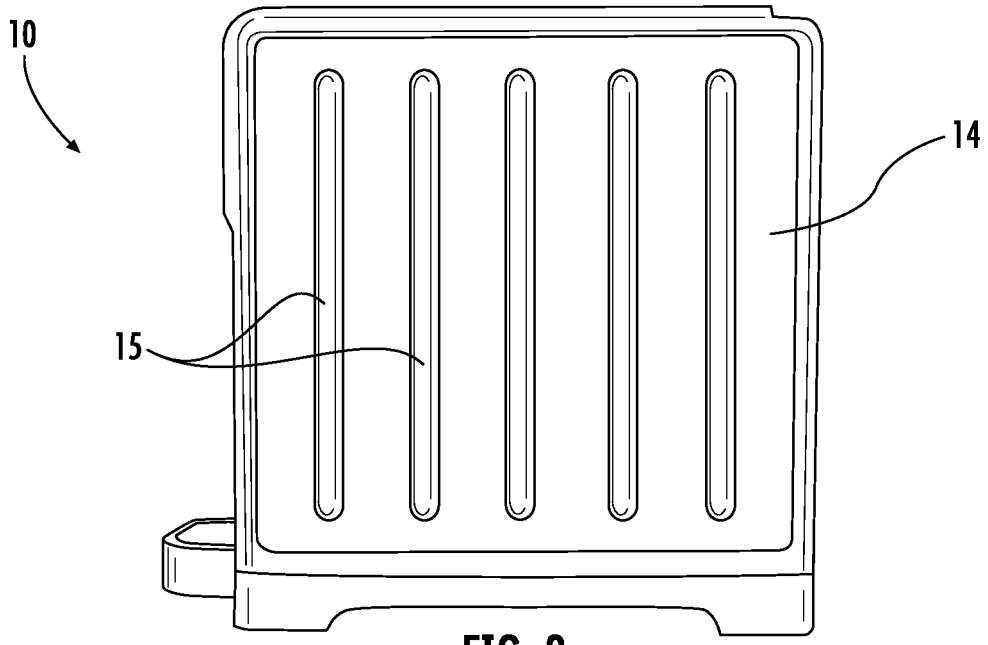
FIG. 3 is an elevated side view of a beverage dispensing apparatus according to an aspect of the present invention.

Additionally, the beverage dispensing apparatus 10 typically includes a cup holder portion 18 configured to receive at least one beverage holding container from a user. In this embodiment, the cup holder portion is positioned beneath the dispenser 16 and projects outward toward the user form the base 19 to create a shelf. FIG. 2 shows another embodiment of the beverage dispensing apparatus 10 having multiple dispensers 16 each configured to dispense different types of fluid from the apparatus 10. The fluids dispensed by the beverage dispensing apparatus 10 may be water, carbonated water, non-carbonated beverages or any other fluid desired by a user. The apparatus 10 produces chilled water, ambient water, hot water, carbonated water, carbonated beverages, non-carbonated beverages or any combination thereof. FIG. 3 shows a side surface 14 of the beverage dispensing apparatus 10 having side panels 15 for a stylized design.

Figure 4A:
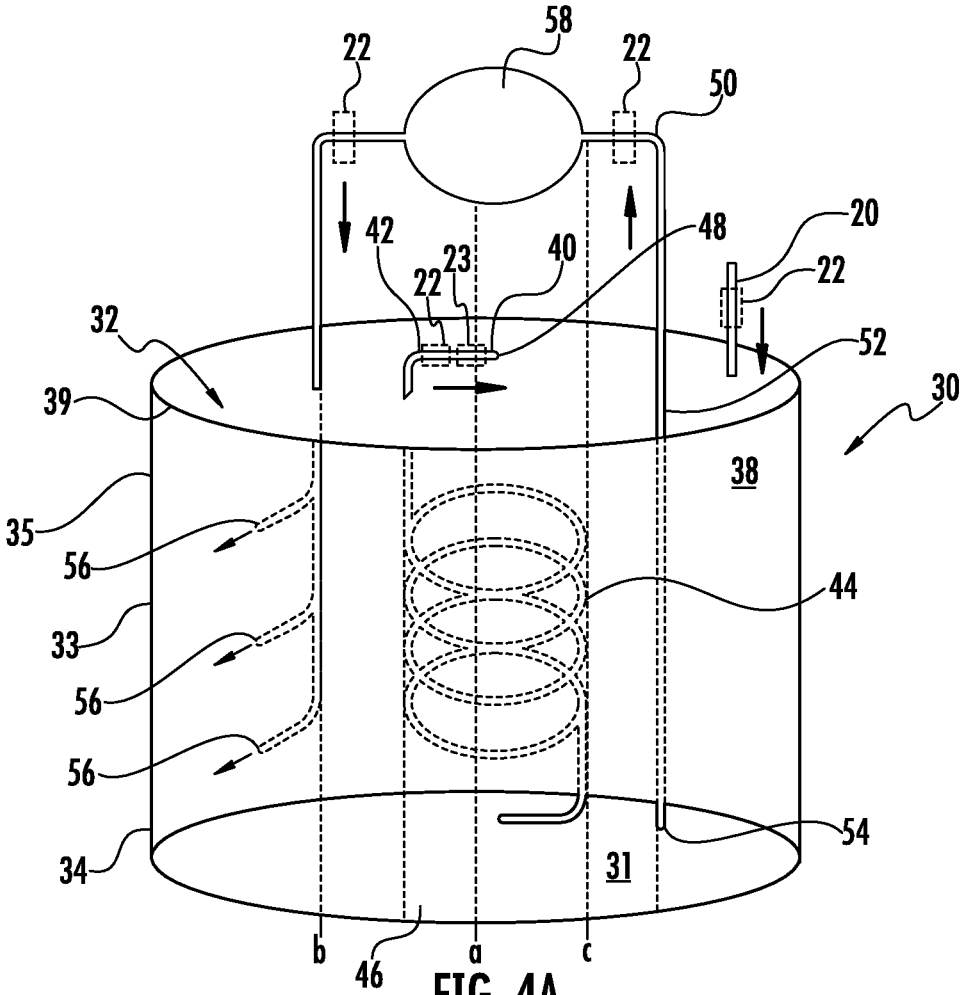
FIG. 4A is a schematic view of a beverage dispensing apparatus according to an aspect of the present invention.
Figure 4B:
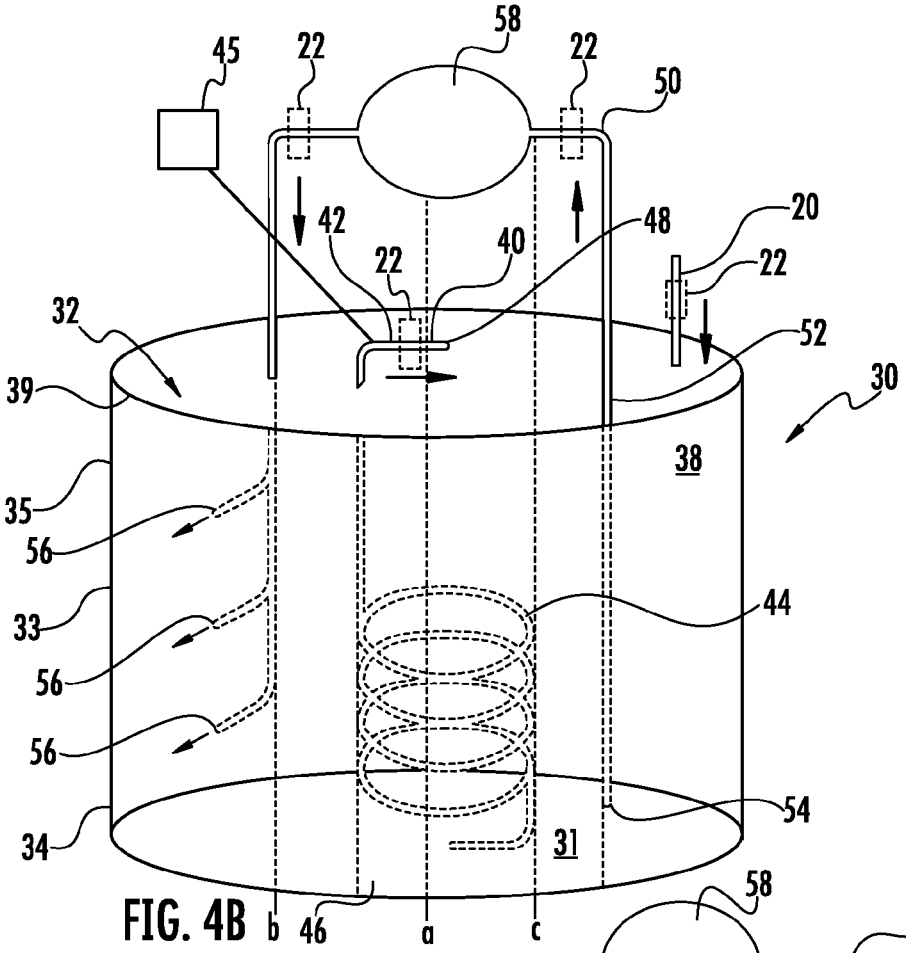
FIG. 4B is a schematic view of another embodiment of a beverage dispensing apparatus according to an aspect of the present invention.

FIGS. 4A and 4B show a schematic layout of the tank 30 and system within the apparatus that provides fluid to a user upon command. The tank 30 is constructed of a plastic polymer material or a thermally conductive metal and typically includes a secondary outer shell to create a double walled insulation encapsulating the evaporator between the inner tank and outer insulative wall. It is contemplated that the tank 30 may be comprised of a variety of materials such as stainless steel with a thermally insulating polymer such that there is no condensation on the outer perimeter sidewall 33 of the tank 30. The beverage dispensing apparatus 10 generally includes a liquid inlet 20 that receives fluid from a fluid source typically potable water source as discussed above. The fluid may be of any liquid but is preferably potable water more preferably potable and filtered water. The fluid source may be a plumbed fluid source, a reservoir source, or any other fluid source as desired by one of ordinary skill in the art.

Alternatively, the tank 30 can be filled manually if the fluid is not plumbed in. The fluid may be filtered by a liquid filter 22 at one or more of a plurality of locations such as prior to entering the storage tank 30, during the fluid circulation process, after removal of the fluid from the storage tank 30 through the dispensing fluid conduit 42, or any combination thereof in order to provide the user with a filtered fluid. Alternatively, or in conjunction with any embodiment of the present invention, the fluid inlet 20 may include a by-pass valve (not shown) disposed before or after the filter of the fluid source to provide ambient filtered or unfiltered water to a user upon command. When carbonated fluid (water) is to be dispensed an in-line carbonator 23 may be used.

As shown in FIG. 4A, the storage tank 30 receives fluid from the liquid inlet 20 and the tank 30 further includes a bottom surface 31 with an upwardly extending perimeter sidewall 33 which extends upwardly from the bottom surface 31 to define an interior volume 32 of the tank 30. The upwardly extending sidewall has an outer surface and an inner surface 38. Further, the tank 30 has a bottom portion 34, a top portion 35, and a tank perimeter 39.

The beverage dispensing apparatus 10 as shown in the embodiment of FIG. 4, also includes the fluid circulating system 50. The fluid circulating system 50 includes the at least one fluid circulation conduit 52 and the at least one fluid cycling device 58. The at least one fluid circulation conduit 52 has an inlet portion 54 positioned in the bottom portion 34 of the tank 30. The inlet portion may be positioned in the bottom half, third, quarter or less of the tank. Most typically the inlet is positioned adjacent to the bottom, but just above physically touching the bottom surface of the tank. The fluid circulation conduit 52 also includes outlet 56 or outlets which are typically disposed on the inside surface 38 of the sidewall 32 of the storage tank 30. Typically, the plurality of outlets 56 are disposed linearly on or immediately adjacent but not touching the inside surface 38 of the sidewall 33 of the storage tank 30. As discussed above, the at least one outlet 56 produces a fluid flow tangential to the orientation of the dispensing fluid conduit 42 configuration. The outlets 56 are configured so that when fluid travels (is dispensed) out of the outlet 56, a helical fluid flow may be forced by the outlets 56 inside of the tank 30. A fluid cycling device 58 is in fluid communication with the at least one fluid circulation conduit 52. Typically the fluid cycling device 58 is a pump device, most typically a water pump. The fluid cycling device 58 moves fluid from the bottom portion 34 of the tank 30 into the inlet 54 of the fluid circulation conduit 52. The fluid circulation conduit also facilitates the delivery of fluid at a substantially uniform temperature, i.e. with about 2° F. tolerance or another desired tolerance range.

Referring again to the embodiments shown in FIGS. 4A and 4B, the outlets 56 are configured to produce fluid flow within the tank 30. The fluid flow is typically a circular or swirling fluid flow which acts to produce an even temperature distribution throughout the interior volume 32 of the tank 30. Moreover, the fluid flow may be configured to flow about an axis. The fluid may flow around axis "a" which is a generally centrally located axis, axis "b" which is generally disposed about one-third of the tank width away from one perimeter sidewall 33 of the storage tank, or axis "c" which is generally about two-thirds of the tank width away from the same perimeter sidewall 33. A helical or circular flow may be forced by the outlets 56 about any or all of axis a, b, and c or any other axis as described by one of ordinary skill in the art. The outlets 56 may also be configured to produce any other fluid flow orientation within the tank 30 as known by one of ordinary skill in the art.

The embodiment shown in FIGS. 4A and 4B also shows the fluid dispensing system 40. The dispensing system 40 includes the dispensing fluid conduit 42 and includes a non-linear portion 44. The non-linear portion 44 may be helical in shape, wavy in shape, zig-zag in shape, or any other shape one of ordinary skill in the art would use to increase the length and thus volume of liquid stored in the dispensing fluid conduit 42. Moreover, the non-linear portion 44 may have a bias towards the top portion 35 of the tank 30, or more preferably towards the bottom portion 34 of the tank 30 as shown in FIG. 4B. Typically the non-linear portion extends along at least a majority of the height of the tank and is positioned in the middle ½ or ¾ of the height of the tank.

Figure 7:
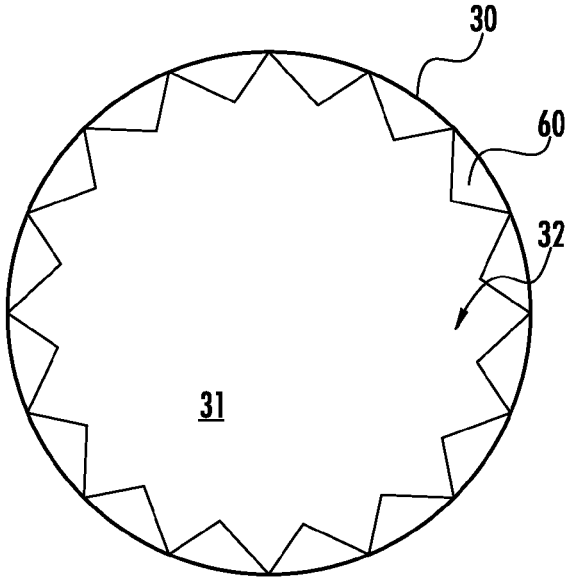
FIG. 7 is a top plan view of one embodiment of the storage tank of a beverage dispensing apparatus according to an aspect of the present invention.
Figure 8:
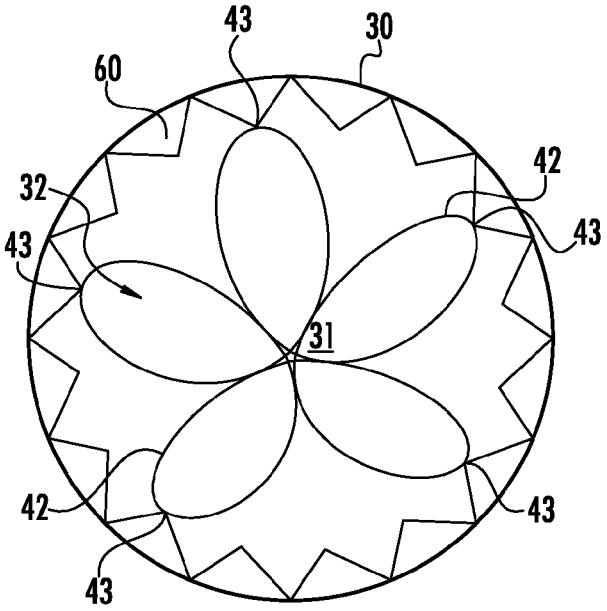
FIG. 8 is a top plan view of another embodiment of the storage tank of a beverage dispensing apparatus according to an aspect of the present invention.

The non-linear portion 44 of the dispensing fluid conduit 42 may also be configured to come into abutting contact 43 with and frictionally and securely hold a fin insert 60 (FIGS. 6-7) inside of the tank 30 (FIG. 8). While shown in varying elliptical pathways in FIG. 8, the non-linear portion may be helical and have a diameter large enough to come into abutting contact with the fin insert 60 to frictionally retain the fin insert 60 in position in the tank. Typically, the dispensing fluid conduit 42 is at least substantially vertically oriented within the interior volume 32 of the tank 30. Most typically, the dispensing fluid conduit 42 is vertically oriented within the interior volume 32 of the tank 30 and has an inlet 46 located in a bottom portion 34 of the tank 30. The fluid dispensing conduit 42 also includes the outlet 48 typically positioned out of the interior volume 32 of the tank 30. The outlet 48 is configured to provide fluid to a user upon a user command.

As discussed previously, fluid delivered to a user upon user command may be chilled water, ambient water, hot water, carbonated water, carbonated beverages, non-carbonated beverages, or any combination thereof. In the embodiment shown in FIG. 4, the tank 30 is pressurized such that when ambient fluid enters into the tank through the inlet 20, chilled fluid is forced into the dispensing fluid conduit 42 and is dispensed through the outlet 48 of the dispensing fluid conduit 42. Alternatively, or in addition, a pump 45 (FIG. 4B) may be operably coupled to the dispensing fluid conduit 42 to draw fluid from the bottom portion 34 of the tank 30 up through the inlet 46 of the dispensing fluid conduit 42 and out the outlet of the dispensing fluid conduit 42 and to a user, upon a user command.

Figure 5A:
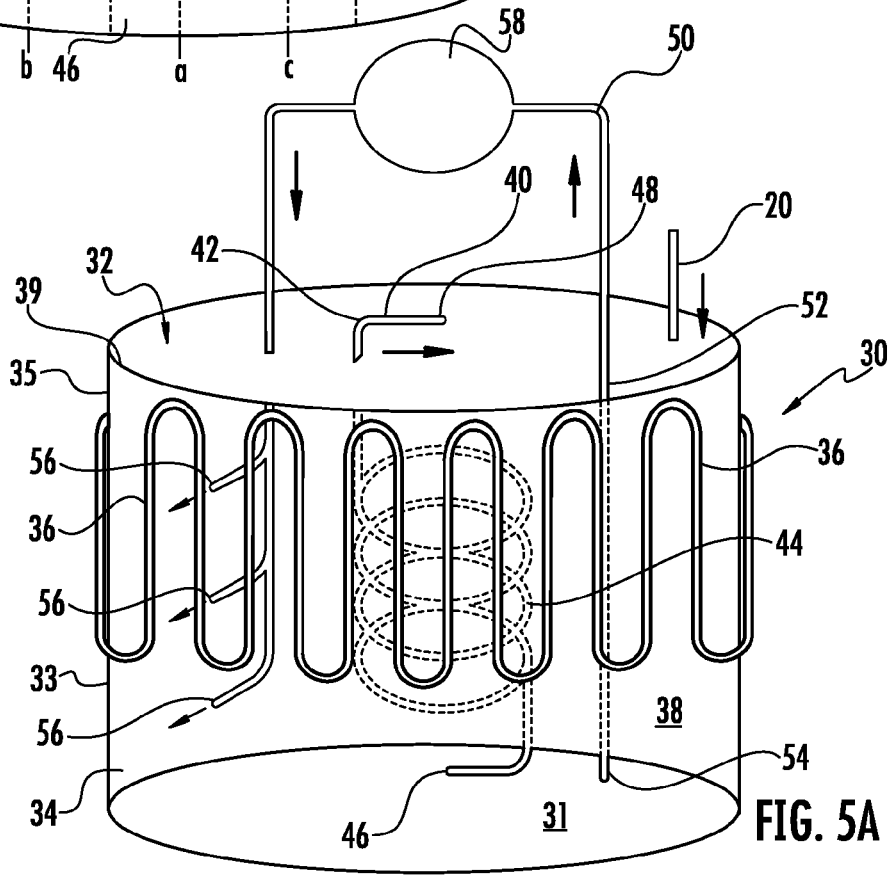
FIG. 5A is a schematic view of another embodiment of a beverage dispensing apparatus according to an aspect of the present invention.
Figure 5B:
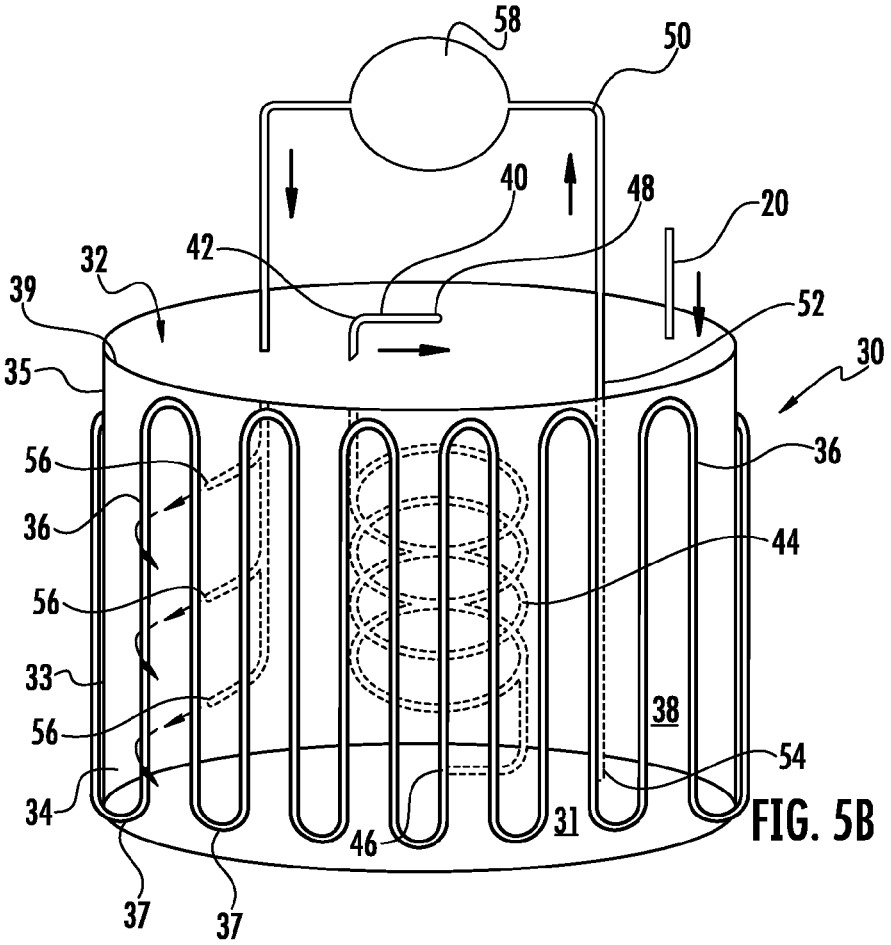
FIG. 5B is a schematic view of yet another embodiment of a beverage dispensing apparatus according to an aspect of the present invention.

In the embodiment shown in FIGS. 5A and 5B, the evaporator's coils extend around the perimeter 39 of the tank 30 and are configured to maintain the fluid disposed in the bottom portion 34 of the tank 30 at the coldest possible temperature without freezing, in the case of water above 32° F. Moreover, the evaporator coils 36 are configured to extend substantially the entire length of the perimeter sidewall 33 (FIG. 5B). Alternatively, the evaporator coils may extend the length of the bottom portion 34, the top portion 35 (FIG. 5A), or any length as desired by one of ordinary skill in the art in order to cool the fluid in the tank 30 to the coolest possible temperature without freezing. Preferably, the evaporator coils 36 extend around the top portions 35 of the tank 30 and may produce ice on the top portion of the tank 30 while allowing the bottom portion 34 of the tank 30 to remain at the lowest possible temperature without freezing, typically at a temperature of from about 33-34° F. when water, treated or untreated with flavorant and/or carbonation for example is used.

Figure 6:
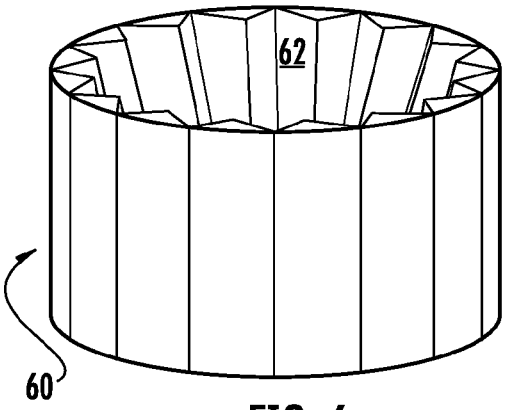
FIG. 6 is a side perspective view of a fin insert showing a plurality of fins according to an aspect of the present invention.
Figure 9:
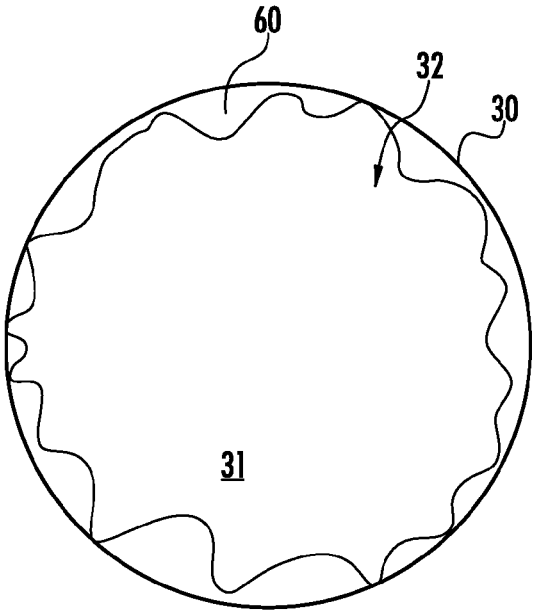
FIG. 9 is a top plan view of yet another embodiment of the storage tank of a beverage dispensing apparatus according to an aspect of the present invention.

Referring now to FIGS. 6-9, the tank 30 may include a fin insert 60 which is disposed about an inside perimeter 39 of the tank 30 as shown in FIGS. 7, 8 and 9. The fin insert 60 is configured to improve heat transfer in the tank 30. Typically, the fin insert 60 having fins 62 is a simple wavy or saw-toothed ring made from coated aluminum but could also be constructed of stainless steel or any other material having a high heat transfer coefficient. The diameter of the fin insert 60 is large enough to cause ring interference with the tank 30 which improves contact resistance in the tank 30. The fin insert 60 typically has a plurality of wavy portions which form smooth or pointed V-shaped channels on the interior surface the sidewall 33 of the tank 30 as shown in FIGS. 6-8. However, the inside surface of the fin insert 60 may include zig-zag protrusions, tapered protrusions, combination thereof, or any other surface alteration, including non-uniform surface protrusions as shown in FIG. 9. The inside surface of the fin 60 may also be configured to help force or sustain the fluid flow in the tank 30 to optimize cooling.

As discussed herein, it is contemplated that a carbonator 23 may be included in the beverage dispensing apparatus 10. The carbonator is typically an in-line on demand carbonator such is proposed by pending patent application U.S. 2011/0268845, the disclosure of which is hereby incorporated in its entirety, but it is contemplated that the in-line carbonator may be disposed in the tank 30. Typically, the carbonator includes two inlets; one for the hold water (which is pressurized by a fluid cycling device) and one for $CO_2$ gas. Downstream to the carbonator, typically includes a flow control device (not shown) on the carbonator outlet line in order to adjust the water flow rate. The $CO_2$ pressure is typically from about 3 to 10 psi higher than the water pressure but that range can vary depending on the type of in-line carbonator used. Additionally, a $CO_2$ inlet valve (not shown) may be operably coupled to the tank 30 and a $CO_2$ supply in order to carbonate the fluid inside of the interior volume 32 of the tank 30.

Referring again to the embodiment shown in FIG. 4, when desired by a user, the fluid from the bottom portion 34 of the tank 30 is pumped out of the storage tank 30 through the fluid dispensing conduit, optionally through a carbonator, and then is dispensed to a user either as chilled, carbonated fluid or mixed with a beverage syrup or powder concentrate to become a carbonated beverage. The beverage dispensing apparatus 10 is further configured to provide ambient temperature fluid directly to a user or to provide chilled non-carbonated fluid to a user or to provide cold non-carbonated beverages, upon a user command.

Figure 10:
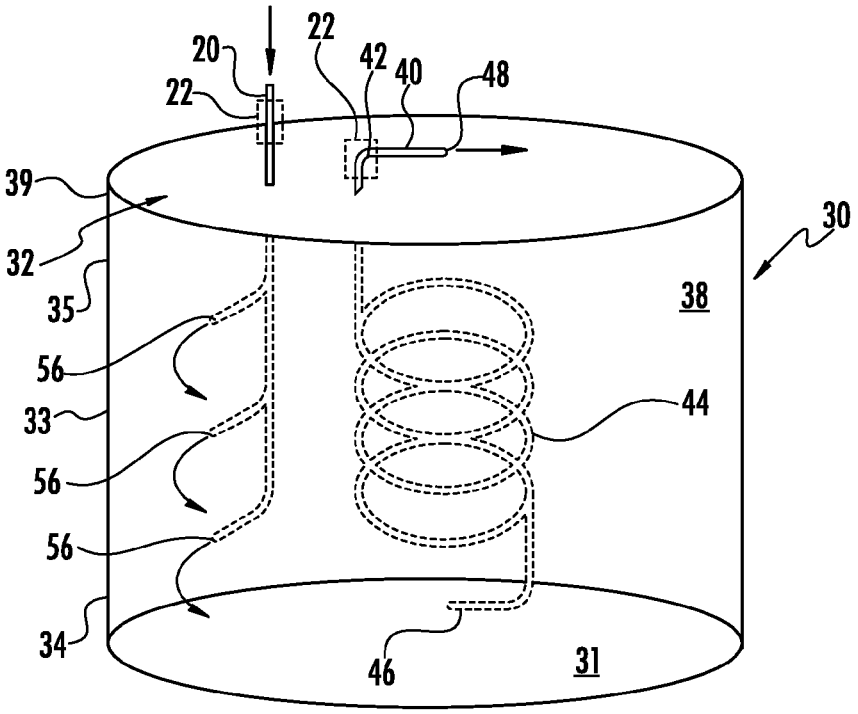
FIG. 10 is a schematic view of a beverage dispensing apparatus according to an aspect of the present invention.

FIG. 10 shows an alternate embodiment of the present invention. In this embodiment, the liquid inlet 20 is still configured to fill the interior volume 32 of the tank 30 with fluid. However, the inlet fluid flows into the fluid circulation conduit 52 and is dispersed out through the fluid circulation conduit outlet 56. Similar to the previous embodiment, the embodiment shown in FIG. 7 produces a fluid flow tangential to the orientation of the dispensing fluid conduit configuration. Additionally, FIG. 10 shows the fluid dispensing system 40 including the non-linear portion 44 and is at least substantially vertically oriented within the interior volume 32 of the tank 30. The fluid dispensing system 40 also includes the fluid dispensing conduit 42 which has the inlet 46 proximate a bottom portion 34 of the tank 30 and the outlet 48 typically positioned out of the interior volume 32 of the tank 30 and is configured to provide fluid to a user upon user command. The filter 22 is shown treating intake water after it is received by inlet 20.

Again, evaporator coils 36 may extend around a perimeter 39 of the tank 30 and may be similar to the evaporator coils 36 shown in the embodiment in FIGS. 5A and 5B. The evaporator coils 36 are in thermal communication with the tank 30 and are configured to chill the fluid within the tank 30 to the lowest possible temperature without freezing. The embodiment shown in FIG. 10 may also include at least one fin 60 according to any of the embodiments described above and shown in FIGS. 6-9, in order to improve heat transfer of the tank 30.

For purposes of description herein, the terms "upper," "lower," "right," "left," "rear," "front," "vertical," "horizontal," and derivatives thereof shall relate to the customizable multi-stage fluid treatment assembly as oriented in FIG. 1. However, it is to be understood that the customizable multi-stage fluid treatment assembly may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A beverage dispensing apparatus comprising:

a tank configured to receive and retain a fluid and having a bottom surface, a top surface, and at least one upwardly extending perimeter sidewall extending upwards from the bottom surface defining an interior volume and a tank sidewall exterior surface;

a liquid inlet configured to deliver the fluid from a fluid source to the interior volume of the tank;

a fluid dispensing system comprising:

a dispensing fluid conduit having a helical portion at least substantially vertically oriented within the interior volume of the tank and wherein the dispensing fluid conduit has an inlet proximate a bottom portion of the tank and an outlet positioned out of the interior volume of the tank wherein the inlet receives fluid from proximate the bottom of the tank, and wherein the fluid in the tank and the fluid received from the tank through the inlet are the same fluid;

a fluid circulating system comprising:

at least one fluid circulation conduit having an inlet portion positioned proximate the bottom portion of the tank and at least one outlet; and a fluid cycling device in fluid communication with the at least one fluid circulation conduit and configured to move fluid from the bottom portion of the tank to the fluid circulation conduit wherein the at least one outlet is configured to produce a fluid flow of the fluid that is tangential to the orientation of the dispensing fluid conduit configuration; and an evaporator extending around at least a portion of the tank sidewall exterior surface, in thermal communication with the tank and configured to chill the fluid within the tank.

2. The beverage dispensing apparatus of claim 1, further comprising at least one fin insert disposed about an inside perimeter of the tank and extending from the at least one upwardly extending sidewall into the interior volume of the tank and extending along at least substantially all of the perimeter sidewall.

3. The beverage dispensing apparatus of claim 1, wherein the dispensing fluid conduit extends from proximate the bottom portion of the tank to about the top surface of the tank and the helical portion is a nonaligned helical portion.

4. The beverage dispensing apparatus of claim 2, further comprising a fluid moving device configured to move fluid within the tank into the inlet of the dispensing fluid conduit and out of the outlet and wherein the at least one fin insert is a single piece fin and includes an inner surface having a plurality of protrusions.

5. The beverage dispensing apparatus of claim 1, wherein the outlet of the fluid circulation conduit is positioned proximate the at least one perimeter sidewall extending upwards from the bottom surface and wherein the helical portion is biased towards the bottom portion of the tank.

6. The beverage dispensing apparatus of claim 1, wherein the fluid cycling device is a fluid pump and the evaporator comprises a series of evaporator coils extending around a perimeter of at least the top portion of the tank sidewall exterior surface.

7. The beverage dispensing apparatus of claim 1, wherein the fluid outlet of the fluid circulation conduit is disposed proximate and along at least a portion of the perimeter sidewall of the tank and wherein the interior volume of the tank is pressurized and configured such that the addition of fluid from the inlet of the fluid dispensing system forces chilled water to be dispensed from the outlet of the fluid dispensing conduit.

8. The beverage dispensing apparatus of claim 1, wherein the fluid outlet of the fluid circulation conduit is curvilinear and is configured to dispense the fluid onto and along an inside surface of the at least one perimeter sidewall forcing a spiraling fluid flow inside of the tank.

9. The beverage dispensing apparatus of claim 1, wherein the fluid is water and the evaporator comprises a series of evaporator coils that are positioned physically engaged to the tank sidewall exterior surface to chill the liquid in the tank.

10. A beverage dispensing apparatus comprising:

a tank configured to receive and retain fluid and having a bottom surface, a top surface, and at least one upwardly extending perimeter sidewall extending upwards from the bottom surface defining an interior volume;

a liquid inlet configured to deliver fluid from a fluid source to the interior volume of the tank;

a fluid dispensing system comprising:

a dispensing fluid conduit having a non-linear portion that extends from proximate the bottom of the tank to about the top surface of the tank and at least substantially vertically oriented within the interior volume of the tank and wherein the dispensing fluid conduit has an inlet proximate a bottom portion of the tank and an outlet positioned out of the interior volume of the tank wherein the inlet receives fluid from proximate the bottom of the tank, and wherein the fluid in the tank and the fluid received from the tank through the inlet are the same fluid; and a fluid circulating system comprising:

at least one fluid circulation conduit having an inlet portion positioned proximate the bottom portion of the tank and at least one outlet positioned proximate the at least one perimeter sidewall of the tank;

a fluid pump in fluid communication with the at least one fluid circulation conduit and configured to move fluid from the bottom portion of the tank to the fluid circulation conduit wherein the at least one outlet is configured to produce a fluid flow tangential to the orientation of the dispensing fluid conduit configuration;

evaporator coils extending around a perimeter of the tank, in thermal communication with the tank and configured to chill the fluid within the tank; and at least one fin disposed about an inside perimeter of the tank.

11. The beverage dispensing apparatus of claim 10, wherein the fluid outlet of the fluid circulation conduit is configured to dispense the fluid onto an inside surface of the at least one perimeter sidewall forcing a helical fluid flow inside of the tank.

12. The beverage dispensing apparatus of claim 10, wherein the fin has a different heat transfer coefficient than the tank.

13. The beverage dispensing apparatus of claim 10, wherein the fluid is water.

14. The beverage dispensing apparatus of claim 10, wherein the at least one fin is a wavy ring comprised of coated aluminum.

15. A method for producing a chilled beverage comprising the steps of:

receiving at least one fluid into a tank from a fluid source via a liquid inlet, wherein the tank includes a bottom surface, and at least one upwardly extending perimeter sidewall extending upwards from the bottom surface defining an interior volume and having an exterior surface and an interior surface;

cooling the at least one fluid inside of the tank using at least one evaporator coil in thermal communication with the tank and extending around at least a portion of a perimeter of the tank;

circulating the fluid through at least one fluid circulation conduit having an inlet portion positioned proximate the bottom portion of the tank and at least one outlet;

moving the fluid from the bottom portion of the tank into the fluid circulation conduit using a fluid cycling device in fluid communication with the at least one fluid circulation conduit;

producing a fluid flow about and along the interior surface of the tank; and dispensing the fluid to a user through a dispensing fluid conduit having a non-linear portion at least substantially vertically oriented within the interior volume of the tank, an inlet proximate a bottom portion of the tank, and an outlet positioned out of the interior volume of the tank wherein the inlet receives fluid from proximate the bottom of the tank, and wherein the fluid in the tank and the fluid received from the tank through the inlet are the same fluid.

16. The method of claim 15 further comprising the step of moving the fluid within the tank into the inlet of the dispensing fluid conduit and out of the outlet using a fluid moving device and wherein the fluid flow inside of the tank is tangential to the orientation of the dispensing fluid conduit configuration inside of the tank.

17. The method of claim 15 further comprising the step of inserting at least one fin disposed about an inside perimeter of the tank.

18. The method of claim 17, wherein the at least one fin and the at least one upwardly extending perimeter sidewall of the tank are comprised of different materials having different heat transfer coefficients and wherein the at least one fin is a single piece fin and includes an inner surface having a plurality of protrusions.

19. The method of claim 15, wherein the fluid outlet of the fluid circulation conduit is configured to dispense the fluid onto an inside surface of the at least one perimeter sidewall forcing a helical flow inside of the tank and wherein the dispensing fluid conduit's non-linear portion is at least substantially vertically orientated within the interior volume of the tank.

20. The method of claim 15, wherein the fluid is water and wherein the at least one evaporator coil extend substantially around the top portion of the tank.

* * * * *